United States Patent [19]

Geary

[11] 3,988,828

[45] Nov. 2, 1976

[54] ANIMAL SHEARING APPARATUS

[76] Inventor: William R. C. Geary, 4/18 Kensington Road, South Yarra, Victoria, Australia, 3141

[22] Filed: Feb. 11, 1975

[21] Appl. No.: 549,053

[52] U.S. Cl. ..... 30/210; 30/123.3

[51] Int. Cl.[2] ..... B26B 19/24; B26B 19/34

[58] Field of Search ..... 30/123.3, 209, 210, 30/200, 224, 208

[56] References Cited

UNITED STATES PATENTS

| | | | |
|---|---|---|---|
| 1,214,430 | 1/1917 | Cook | 30/200 |
| 1,958,912 | 5/1934 | Clark | 30/123.3 |

FOREIGN PATENTS OR APPLICATIONS

| | | | |
|---|---|---|---|
| 211,230 | 7/1957 | Australia | 30/210 |
| 5,635 | 1888 | United Kingdom | 30/210 |
| 3,670 | 1891 | United Kingdom | 30/210 |
| 22,324 | 1891 | United Kingdom | 30/210 |
| 15,791 | 1907 | United Kingdom | 30/210 |

*Primary Examiner*—Al Lawrence Smith
*Assistant Examiner*—J. C. Peters
*Attorney, Agent, or Firm*—Holman & Stern

[57] ABSTRACT

Apparatus for shearing sheep and other animals comprises a handpiece provided with a reciprocating fluid operated motor, the reciprocating element of which directly actuates a transversely oscillatable cutter operating member. The handpiece is connected by flexible tubing to power generating means by which successive pressure pulses are imparted to the fluid, preferably a hydraulic fluid, such pulses being transmitted through the tubing to the motor so that the cutter operating member of the handpiece is oscillated in unison therewith. The said power generating means preferably comprises a master cylinder which communicates with a hydraulic fluid reservoir which maintains the system full of fluid and said pressure pulses are produced by a plunger which is reciprocated in the master cylinder by power operated means. The master cylinder, also, preferably communicates with a transfer chamber, the volumetric capacity of which may be varied by operation of manual control means, whereby when its capacity is increased beyond its normal operating capacity, liquid passes thereinto from the master cylinder to interrupt the production of said pressure pulses in the master cylinder while said power operating means continues to operate.

6 Claims, 9 Drawing Figures

ANIMAL SHEARING APPARATUS

FIELD OF THE INVENTION

This invention relates to apparatus for shearing animals —especially sheep —and is concerned both with improvements in power operated shearing handpieces and with remotely located power generating means therefor.

BACKGROUND OF THE INVENTION

For a great many years, it has been the conventional practice to shear sheep with power operated handpieces which comprise a body fitted with a comb and with a pivoted member, termed a fork, by which a cutter is oscillated across the comb face to sever the wool. The fork is actuated by an overhead driving mechanism from which rotary motion is transmitted by a rotary shaft comprising successive sections connected by universal joints or the like.

The conventional handpiece is relatively large and heavy and its aforesaid jointed driving shaft limits its maneuverability and so restricts the positions in which the animals may be arranged during the shearing operation.

Although, notwithstanding these limitations, the conventional mechanically driven handpiece has been successfully used for many years to shear sheep in the conventional manner, it does not permit of the degree of maneuverability which is desirable in all circumstances, but which is more important, if not necessary, when for example, it is desired to shear sheep which are inverted and suspended by their four legs from a conveyor as disclosed for example in the specifications of my prior Australian Pats. Nos. 252521 and 410488. Such conveyor shearing procedures are now sometimes compendiously designated "chain shearing".

During recent years there have been various proposals for incorporating an electric, air driven or hydraulic motor in each handpiece but in general, such motor driven handpieces are relatively bulky and expensive and in most cases are also subject to other disadvantages of one kind or another. In all such proposals known to me the motor has a rotary output shaft for a crank or other actuating device for the, pivoted fork.

SUMMARY OF THE INVENTION

In one aspect, this invention provides shearing apparatus comprising, in combination, a shearing handpiece and spaced power generating means therefor, wherein said handpiece comprises a body, a cutter operating member movably mounted on the body and so as to be transversely oscillatable thereon, and a reciprocating, fluid operated motor for actuating the cutter operating member, and wherein said power generating means comprises power operated means for imparting successive pressure pulses to a confined fluid, and flexible tubing connecting said power generating means to said motor on the handpiece whereby the cutter operating member is constrained to oscillate in unison with said pressure pulses. The fluid may be gaseous but is preferably a liquid to provide more positive operation.

The invention also provides hydraulic power generating means suitable for the aforesaid purpose, comprising a hydraulic master cylinder, a plunger reciprocable therein to produce successive pressure pulses in the liquid, power actuated driving means for the plunger, a hydraulic fluid reservoir communicating with the master cylinder for the supply thereto of fluid under a substantially constant pressure which is intermediate between the maximum and minimum pressures in the master cylinder and manual control means operable to interrupt the production of said pressure pulses while said power actuated driving means continues to operate.

For the last mentioned purpose, the master cylinder preferably communicates with a transfer chamber, the volumetric capacity of which may be increased beyond its normal capacity by operation of said manual control means whereby additional fluid passes thereinto from the master cylinder and means for preventing the further inflow of liquid from the reservoir when the capacity of the transfer chamber in thus increased.

The invention further provides a shearing handpiece comprising a body, a transversely oscillatable cutter operating member movably retained to the body and a reciprocating fluid operated motor for actuating said oscillatable member, said motor being operable by pressure pulses transmitted through the fluid.

Preferably, the motor comprises at least one cylinder and a co-acting plunger or piston, either one of which may be fixed to the body while the other is arranged to directly engage and operate the said displaceable member, though if desired, the plunger may be replaced by an equivalent flexible diaphragm or bellows.

Preferably, the oscillatable member is moved in one direction only by fluid pressure, in which case such movements are resiliently resisted by a return spring or other resilient means which may conveniently be arranged at the opposite side of the said member.

If desired however, the oscillatable member may be moved in each direction by fluid pressure and for this purpose the motor may comprise two cylinders, which are preferably arranged co-axially at the opposite sides of the oscillatable member, each cylinder being provided with a plunger or equivalent means by which the oscillatable member is pushed towards the opposite cylinder, it being understood that the pressure pulses are then transmitted to the opposed plungers alternately.

Alternatively, the same result may be achieved by replacing the opposed cylinders by a single cylinder, double-acting, piston motor.

Still other features of the invention include improved means for continuously or intermittently lubricating the handpiece and the provision on the body or the handgrip of a shelf which projects forwardly below the rear part of the comb to permit of a reduction of the contact pressure between the comb and the skin of the animal.

In order however, that the invention may be more clearly understood, particular forms thereof are hereinafter more fully described with reference to the accompanying drawings in which:

DESCRIPTION OF THE PREFERRED EMBODIMENTS

Figure 1:
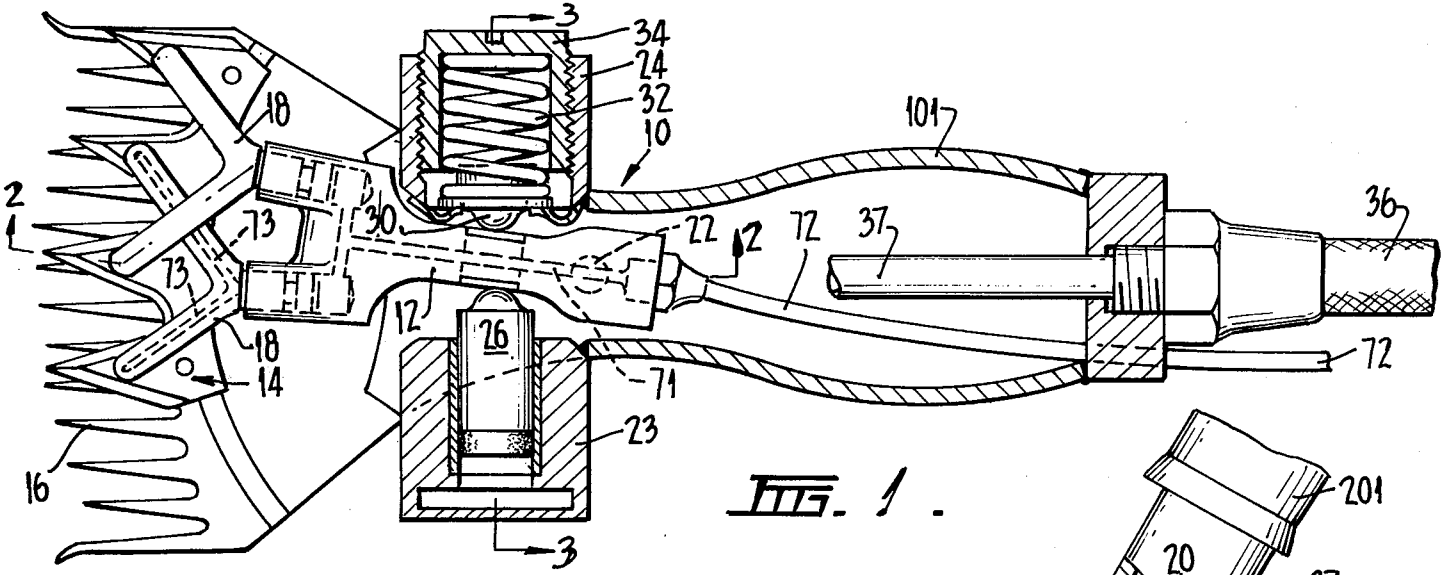
FIG. 1 is a view in sectional plan of one form of hydraulically operated shearing handpiece according to the invention.
Figure 2:
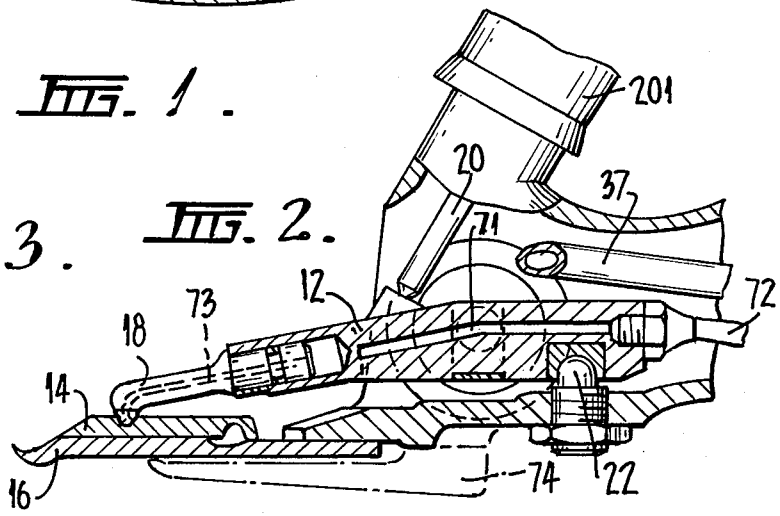
FIG. 2 is a view in sectional side elevation taken on the line 2—2 of FIG. 1.
Figure 3:
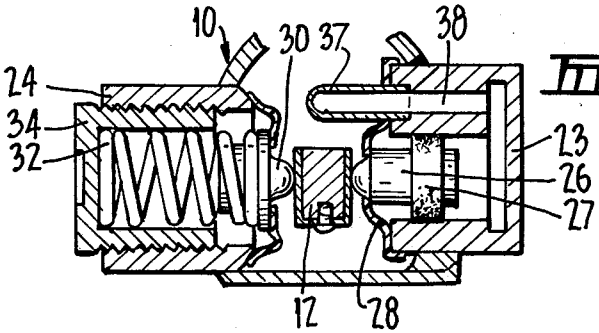
FIG. 3 is a view in sectional end elevation taken on the line 3—3 of FIG. 1 and shows a minor modification.

Referring initially to FIGS. 1, 2 and 3, the handpiece shown therein is generally similar in its main features to a conventional power operated handpiece in that it comprises a hollow body 10, the rear portion of which forms an integral handgrip 101, and a longitudinally extending arm or fork 12 which is pivotally mounted on a vertically disposed domed pivot pin 22 fixed to the body and this pivoted fork is arranged to oscillate a toothed cutter 14 transversely across the face of a conventional comb 16 which is detachably secured to the forward end of the body and which forms a co-acting cutter member.

For this purpose, the forward end portion of the pivoted arm is forked or bifurcated and each free end portion thereof is fitted, as is usual, with a pair of so-called "crows feet" 18, the free forward ends of which engage locating depressions in the upper face of the cutter 14.

The handpiece is also provided with a conventional inclined compression strut 20 which by operation of a screw cap 201 is adapted to exert a sufficient downward pressure on the pivoted arm forwardly of the pivot pin 22.

The body 10 is provided forwardly of the pivot pin 22, and on the opposite sides of the pivoted arm 12, with two transversely arranged coaxial cylinders comprising a hydraulic motor cylinder 23 which is closed at its outer end and a cylinder 24 which forms a housing for a helical compression return spring 32.

The hydraulic cylinder 23 is fitted with a slidable plunger 26 which is suitably sealed thereto and the inner end of this plunger projects from the cylinder and is formed centrally with a dome-shaped projection which bears against the adjacent side of the pivoted arm 12 which may be provided with a replaceable wear piece as shown.

In the modification shown in FIG. 3, the plunger 26 is substantially smaller in diameter than the cylinder and is sealed to the outer end portion of the latter by a relatively thick ring 27 formed of suitable resilient material which is permanently bonded to the plunger and the cylinder at its inner and outer peripheries respectively. Also, a resilient cover or "sock" 28 of suitable plastics material or rubber may enclose the outer end of the plunger as shown in this Figure.

The inner end of the compression spring 32 is fitted with a cap piece 30 formed with a domed projection for engagement with the respective side of the pivoted arm while the pressure exerted by the spring is adjusted by means of a spring abutment member 34 which has a screw threaded engagement in the outer end of its cylinder. The cap piece 30 may also be enclosed within a resilient plastic sock or the like to prevent the entry of wool and dust.

In use, the outer end of the motor cylinder 23 is filled with hydraulic fluid and is connected by a flexible tube 36 to the remotely located hydraulic power generating apparatus, hereinafter described. In the illustrated construction this tube is connected to the rear end of the handgrip 101 as shown in FIG. 1 and is extended within the hollow handgrip by a tube 37, which may be either rigid or flexible, to the inner end of the cylinder 23 where is communicates with the adjacent end of a hole 38 which extends longitudinally through the cylinder wall to a cavity at the closed outer end of the cylinder as shown in FIG. 3.

If desired however, the handgrip 101 may be detachably secured to the body 10 in which case it may consist of a tube which is screwthreaded externally at its inner end to engage a screw threaded socket formed on the body close to the rear end of the pivoted arm 12. Also this handgrip tube may be open at its outer end so that the flexible tube 36 may then extend therethrough for direct attachment to the cylinder 23.

Figure 7:
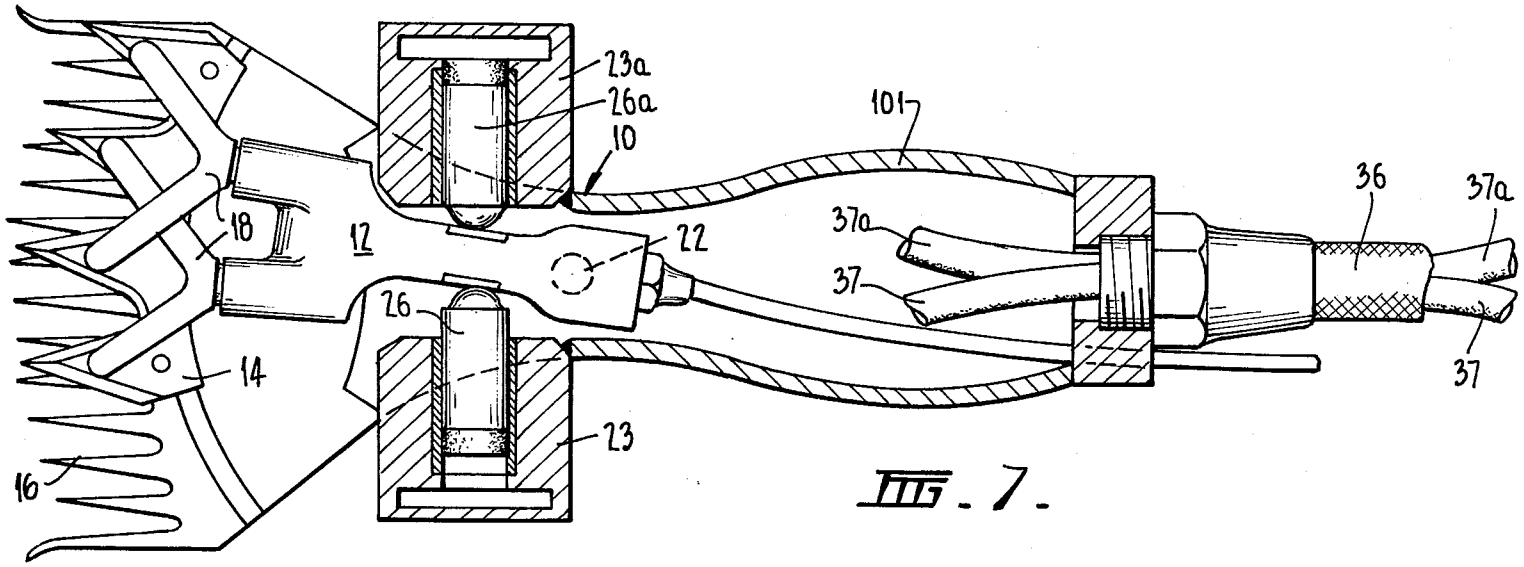
FIG. 7 is a view similar to FIG. 1 and shows a modification of the invention.

The return spring 32 and its housing cylinder 24 may, if desired, and as shown in FIG. 7, be replaced by a second hydraulic motor cylinder identical with the motor cylinder 23 in which case the plunger 29*a* of this second motor cylinder 23*a* is actuated in the manner hereinafter described by pressure pulses transmitted through a flexible tube 37*a* and which are opposite in phase to those supplied to the cylinder 23 whereby as either motor plunger 26 or 26a is projected by a pressure pulse, the other is retracted.

The remotely located power generating apparatus imparts successive regular pressure pulses to the hydraulic fluid at a suitable frequency so that each such pulse serves to project the hydraulic plunger 26 inwardly and thereby displace the pivoted cutter arm 12 in opposition to the return spring 32, while in the intervals between such pulses, this spring returns the cutter arm in the opposite direction. Thus, the cutter is oscillated at a predetermined frequency across the face of the comb 16.

Figure 4:
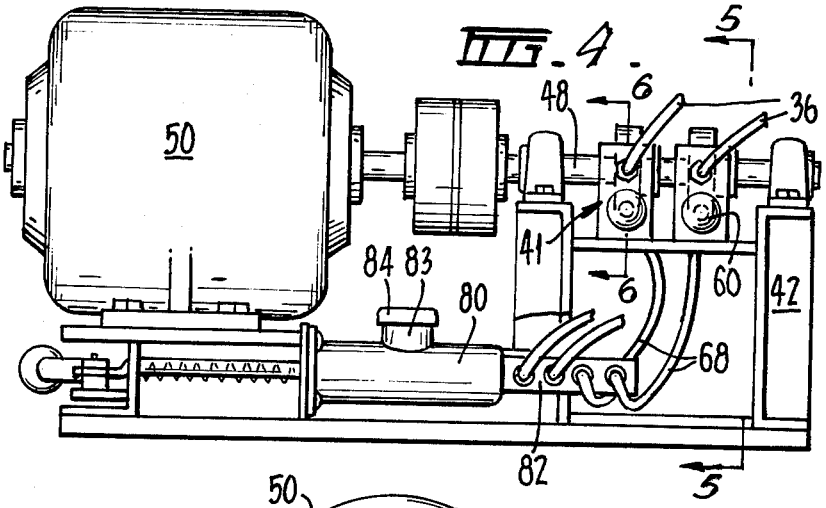
FIG. 4 is a view in side elevation of one form of hydraulic actuating apparatus for a plurality of shearing handpieces.
Figure 5:
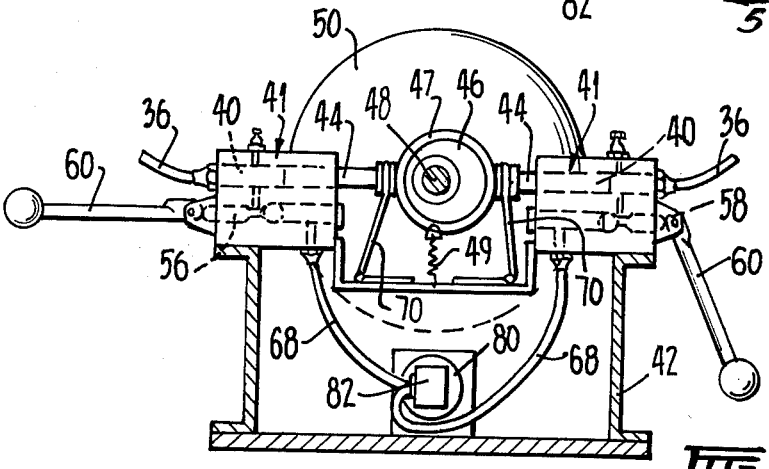
FIG. 5 is a view in sectional end elevation taken on the line 4—4 of FIG. 4.
Figure 6:
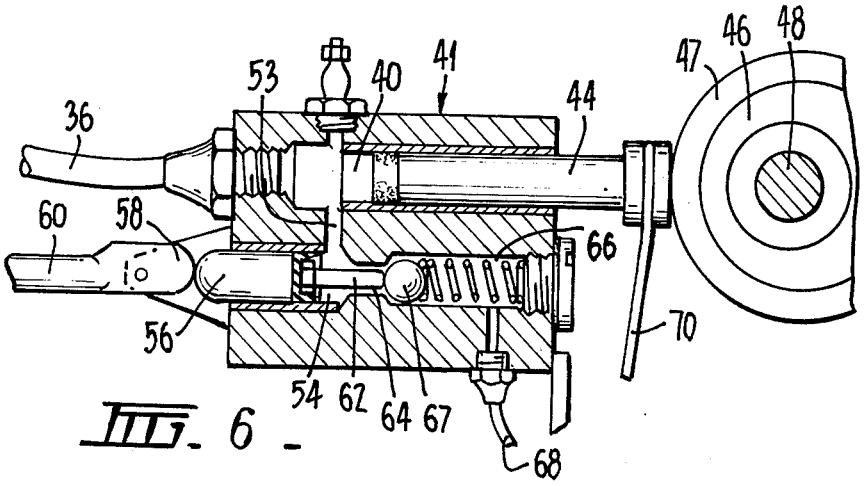
FIG. 6 is a view in sectional end elevation taken on the line 6—6 of FIG. 4.

At its opposite end, the flexible tube 36 is connected to the closed outer end of a corresponding master cylinder 40 in hydraulic power generating apparatus, one suitable form of which is shown in FIGS. 4, 5 and 6, this actuating apparatus being arranged in any convenient fixed position adjacent the shearing area.

This illustrated power generating apparatus comprises four master cylinders 40 each of which may be connected to a corresponding handpiece, it being understood that any required number of cylinders 40 may be provided.

Each master cylinder 40 is formed horizontally in an individual cylinder block 41 mounted on a suitable base frame 42 and is fitted with a slidable plunger 44 which projects form one end thereof for actuation by an eccentric 46 mounted on a spindle 48 driven by an electric motor 50. Preferably and as shown, a ball race 47 is mounted on the periphery of the eccentric so that the outer ring thereof engages the plunger 44. In this way, friction and wear are reduced as the eccentric rotates freely within the said outer ring, the angular movement of which is restrained by an anchor spring 49 and so is constrained to gyrate about the rotational axis with minimum rubbing movement between it and the plungers 44.

In the illustrated construction, two cylinder blocks 41 are arranged side-by-side at each side of the spindle 48, each cylinder being co-axial with a cylinder at the opposite side of the spindle so that each eccentric 46 operates the plungers 44 of an opposed pair of cylinders.

Each cylinder 40 is connected within its respective block by a transverse passage 53 to the inner end of a parallel cylinder 54 herein termed a transfer cylinder, fitted with a slidable plunger 56 which projects therefrom and is engaged by any suitable adjustable stop means e.g. by an angularly movable cam 58 on a pivoted control arm 60. The inner end of the plunger 56 is provided with an axial pin 62 which extends through a reduced neck 64 which connects the cylinder 54 to a co-axial bore 66 containing a spring loaded ball valve 67 which, when the plunger 56 is in its innermost position shown in FIG. 6, is held clear of its adjacent seating by the pin 62.

The bore 66 is connected by a lateral hole and a tube 68 to a reservoir of hydraulic fluid which is maintained under a substantially constant pressure. This reservoir may comprise a horizontal cylinder 80 secured to the base frame 42 and fitted with a manually retractible piston which normally maintains the liquid under a suitable pressure, e.g. by a spring-loaded linkage, the geometry of which is such that the pressure in the reservoir is substantially constant. The closed outer end of the reservoir cylinder 80 communicates with a manifold 82 to which the supply tubes 68 for the several master cylinders 40 are connected by a fitting which includes a non-return valve to prevent reverse flow of fluid from the tube 68 to the reservoir.

Suitable provision is made for bleeding air from the hydraulic system which is thus normally full of hydraulic fluid, any leakage which may occur being automatically replaced from the reservoir cylinder which is provided with an upstanding filling tube 83 which is normally closed and sealed by a cap 84. The pressure maintained in the reservoir cylinder is less than the maximum pressure developed in the master cylinder by the reciprocating plunger 44 but exceeds the minimum pressure therein so that in the intervals between successive pressure pulses additional fluid may pass from the reservoir to the master cylinder to replace any leakage from the system.

When the apparatus is in use, the pressure of the fluid maintains the plunger 44 of each master cylinder 40 in contact with the ballrace 47 of its respective eccentric 46, in opposition to a light strip spring 70 which tends to retract it. Consequently, when the motor 50 is operating, the plunger 44 makes one forward and return stroke during each revolution of the eccentric and each outward stroke imparts a pressure pulse to the fluid in the respective cylinder, this pulse being transmitted by the fluid to the motor of the corresponding handpiece through the flexible tube 36. Thus, the plunger 26 of the motor cylinder 23 of the respective shearing handpiece is a "slave" plunger which is constrained to move in unison with the plunger 44 of the corresponding master cylinder 40.

However, if while the driving motor 50 continues to operate, the control arm 60 of any of the master cylinder assemblies is moved downwardly from its normal horizontal position shown at the left of FIG. 5 to the position shown at the right of that Figure, the hydraulic fluid displaced by the master plunger 44 during its next succeeding inward stroke passes through the transverse passage 53 into the cylinder 54 and forces the plunger 56 outwardly to the extent permitted by the then retracted cam 58 on the control arm, while at the same time, the strip spring 70 withdraws the master plunger 54 through a distance at least equal to the throw of the eccentric 46. When the plunger 56 is thus retracted the ball valve 67 engages its seating to prevent further inflow of fluid from the reservoir cylinder 80.

Consequently, while the control arm 60 is in its retracted position, the master plunger 54 remains stationary in its innermost position even though the eccentric continues to rotate, so that the respective handpiece ceases to operate.

However, by returning the control arm 60 to its normal horizontal, or operative, position, the hydraulic fluid previously transferred to the cylinder 54 is returned to the master cylinder 40. Thus the plunger 44 therein is again forced outwardly into contact with the eccentric 46 so that the respective hand piece again starts to operate.

Consequently, the operator of each handpiece is able to control the operation of his handpiece while the common driving motor operates continuously.

It will also be evident that each eccentric 46 may be replaced by a cam provided with two or more lobes arranged at equal angular intervals in which case two or more pressure pulses are transmitted to the respective handpieces during each rotation of the spindle 48.

As shown in FIGS. 1 and 2, the cutter-comb interface of the handpiece may be continuously or intermittently lubricated by the supply of lubricant from any suitable source at or near the power actuating apparatus through a small diameter flexible tube 72 which may be attached to the exterior of the flexible hose 36. The delivery end of this tube 72 communicates with a longitudinal lubricant passage 71 in the pivoted arm 12 for which purpose the tube 72 may be connected to the rear end of this arm as shown though alternatively the lubricant may pass from the tube 72 to a central passage in the pivot pin 22 and then from the latter to the passage 71 in the arm 12. This passage connects at its forward end with passages in the fork branches at the forward end of the cutter arm and these in turn communicate with passages 73 in the crows feet 18 to supply the lubricant to the upper face of the cutter 14 which in turn may be formed with holes to direct the liquid therethrough to the upper face of the comb 16. Similar provision may be made for lubricating the seating for the domed pivot pin 22 and also the seating on the upper face of the pivoted arm 12 for the lower end of the compression strut.

The lubricant may advantageously also contain a detergent or solvent to assist in keeping the underside of the comb 16 in a clean condition free of wax build-up.

According to a further modification of the handpiece, the lower face of the body 10 is fitted with a shelf member 74, shown in broken lines in FIG. 2, which projects forwardly below and close to the rear end portion of the comb 16 but which has its forward end disposed rearwardly of the wool severing zone. This shelf member is preferably formed of PFTE, which is well known under the registered trade mark TEFLON, or other suitable material with anti-friction properties, to facilitate its movement over the skin of the animal and thus enable the contact pressure exerted thereon to be reduced. This shelf member 74 is preferably formed with clearance holes to provide access to the retaining screws for the comb 16.

Also, this shelf member may be formed at its opposite sides with curved comb teeth to combine with, or preferably to replace, the outermost teeth of a conventional comb. In the latter case, the cost of the comb would be reduced and its cutting width could be increased.

Figure 8:
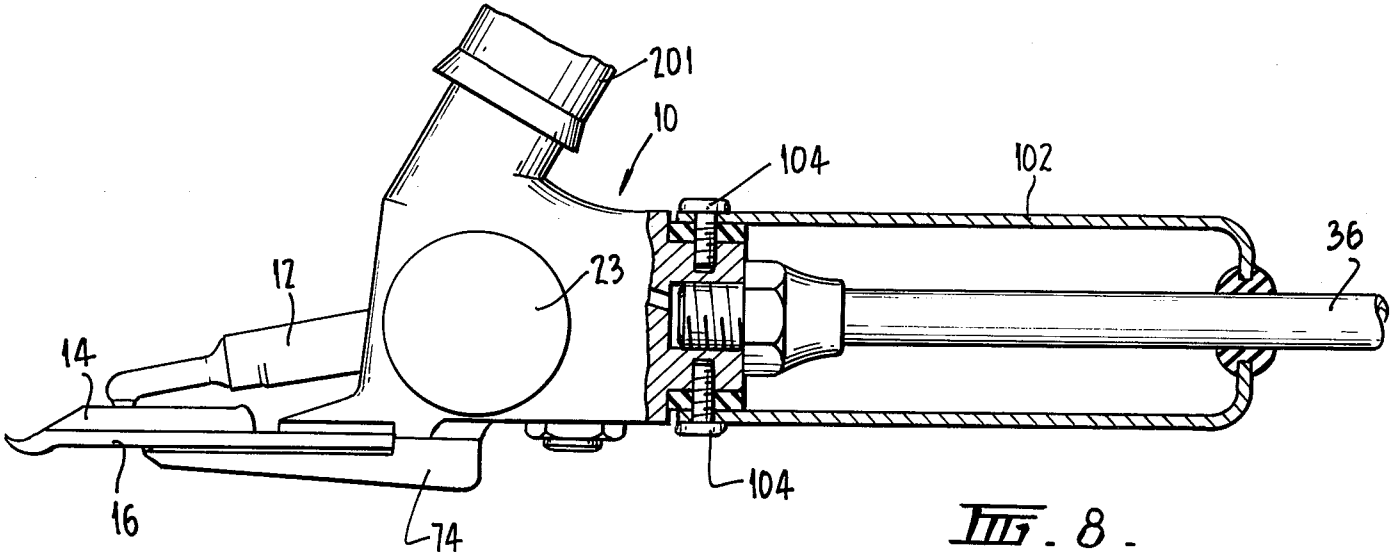
FIG. 8 is a side elevational view, partly in section, showing another embodiment of the hand piece which is provided with a pivoted hand grip.

According to another modification; See FIG. 8, the handpiece is provided with a handgrip 102 which is formed separately from the body 10 and its forward end is pivotally connected to the body about a vertical axis by pivot pins 104. This pivoted handgrip reduces the transmission of vibrations to the hand of the user while also it enable the body 10 to vibrate laterally without restraint by the user. In such circumstances, the body 10, together with the comb 16 fixed thereto, would tend to vibrate laterally at the same frequency as the oscillations of the cutter 14 and so reduce the tendency for skin folds to move upwardly between the comb teeth and so reduce the risk of injury to the animal.

Figure 9:
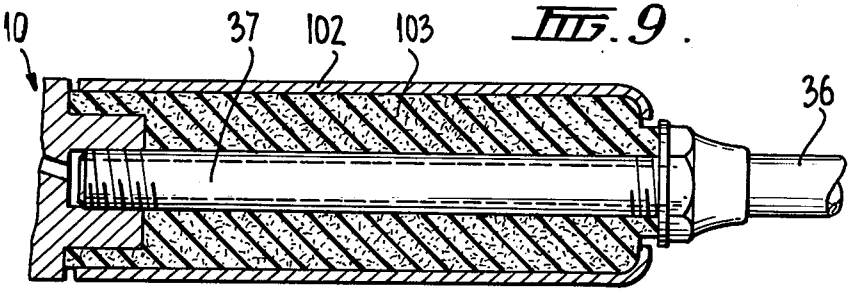
FIG. 9 is a view similar to FIG. 8 showing a resiliently-supported hand grip.

Alternatively and as shown in FIG. 9, a similar result may be achieved by providing the tube 37 with an outer lining 103 of foam rubber or similar resilient material which itself is contained within an outer tubular handgrip 102.

A shearing handpiece as above described is readily and freely maneuverable as it is connected to the power generating means only by one or more flexible tubes of small diameter. Thus the handpiece is suitable for all shearing procedures including chain or conveyor shearing.

Moreover, the handpiece is compact, comparatively light in weight and relatively inexpensive both because the reciprocating motion of the motor is transmitted directly to the pivoted fork forwardly of its pivotal axis and also because the motor does not require inlet and exhaust valves.

I claim:

1. A shearing handpiece comprising a body, a transversely oscillatable cutter operating arm pivotally connected to the body forwardly of a handgrip therefor, thereby to oscillate a toothed cutter across the face of a comb fixed to the body, a hydraulic motor on the body for actuating the cutter operating arm, said motor comprising a cylinder arranged transversely on the body at one side of the cutter operating arm and forwardly of its pivotal axis, a coacting relatively slidable plunger in the cylinder, the cylinder being in contact communication with a source of hydraulic fluid under pressure when the motor is operating, means for connecting cylinder to a flexible tube to a remote power generator operable to impart successive pressure pulses to the hydraulic fluid so that the plunger is movable inwardly by said successive pressure pulses, and said arm is moved towards the opposite side of the body, and means on the body at said opposite side of the arm for moving the latter in the reverse direction in the intervals between said successive pressure pulses.

2. A shearing handpiece according to claim 1 wherein said means for moving the cutter operating arm in the reverse direction, comprises a spring arranged coaxially with the cylinder to resist displacement of the said arm by the plunger, thereby to move the arm in said reverse direction in the intervals between the transmission of successive pressure pulses to the cylinder.

3. A shearing handpiece according to claim 1 wherein said means for moving the cutter coperating arm in the reverse direction, comprises a second hydraulic cylinder arranged coaxially with the first-mentioned cylinder, said second cylinder being provided with a slidable plunger operable to actuate the arm, and means whereby successive pressure pulses may be transmitted to said second hydraulic cylinder through a second flexible supply tube, in the intervals between the transmission of successive pressure pulses to the first-mentioned hydraulic cylinder.

4. A shearing handpiece comprising a body, a cutter operating arm pivotally connected thereto to oscillate a toothed cutter across the face of a comb fixed to the body, a transversely disposed hydraulic motor cylinder on the body at one side of said arm and forwardly of its pivotal axis, a plunger in the cylinder, said plunger being movable inwardly by successive pressure pulses transmitted to a hydraulic fluid in the outer end of the cylinder thereby to move the said arm towards the opposite side of the body, means for the attachment of a flexible tube for the supply of hydraulic fluid under pressure to the cylinder whereby said pressure pulses may be transmitted to the latter from a remote power generator, means on the body, at said opposite side of the cutter operating arm, for moving the arm in the reverse direction in the intervals between successive pressure pulses transmitted to the cylinder and a handgrip movably connected to the said body so as to permit the latter to undergo relative lateral vibrations and thereby reduce the transmission of vibrations to the hand of the user.

5. A shearing handpiece comprising a body, a transversely oscillatable cutter operating arm pivotally connected thereto, a comb fixed to the body and having a wool-severing zone, a toothed cutter operatively-connected to said arm for oscillation, across the face of the comb fixed to the body, a transversely disposed hydraulic motor cylinder on the body at one side of said cutter operating arm and forwardly of its pivotal axis, a plunger in the cylinder, said plunger being movably inwardly by successive pressure pulses transmitted to a hydraulic fluid in the outer end of the cylinder, thereby to move the said arm towards the opposite side of the body, means for the attachment of a flexible tube for supplying pressurized hydraulic fluid to the cylinder so that pressure pulses are transmitted to the latter from a remote power generator, means on the body, at said opposite side of the cutter operating arm, for moving the arm in the reverse direction in the intervals between successive pressure pulses transmitted to the cylinder, and a shelf-like member detachably secured to the underside of the body and extending forwardly below the rear portion of the fixed comb and having its forward end disposed rearwardly of the wool severing zone of the comb.

6. A shearing handpiece comprising a body, a transversely oscillatable cutter operating arm pivotally connected thereto, a comb fixed to the body and having a wool-severing zone, a toothed cutter operatively-connected to said arm for oscillation, across the face of the comb fixed to the body, a transversely disposed hydraulic motor cylinder on the body at one side of said arm and forwardly of its pivotal axis, a plunger in the cylinder, said plunger being movably inwardly by successive pressure pulses transmitted to a hydraulic fluid in the outer end of the cylinder, thereby to move the said arm towards the opposite side of the body, means for the attachment of a flexible tube for supplying pressurized hydraulic fluid under pressure to the cylinder so that pressure pulses are transmitted to the latter from a remote power generator, means on the body, at said opposite side of the cutter operating arm, for moving the arm in the reverse direction in the intervals between successive pressure pulses transmitted to the cylinder, said cutter operating arm including a longitudinally extending lubricant passage for the supply of lubricant to a cutter-comb interface, and including means so that lubricant from a remote source is supplied under pressure through a flexible tube to the said passage.

* * * * *

UNITED STATES PATENT AND TRADEMARK OFFICE

CERTIFICATE OF CORRECTION

PATENT NO. : 3,988,828

DATED : November 2, 1976

INVENTOR(S) : William Richard Clifford Geary

It is certified that error appears in the above-identified patent and that said Letters Patent are hereby corrected as shown below:

Column 7, line 45, delete "contact" and insert --constant--.

line 48, before "cylinder" insert --the--; same line after "cylinder" delete "to" (first occurrence) insert --by Signed and Sealed this Twenty-ninth Day of March 1977

[SEAL]

*Attest:*

RUTH C. MASON
*Attesting Officer*

C. MARSHALL DANN
*Commissioner of Patents and Trademarks*